US005791644A

United States Patent [19]

Regimbal et al.

[11] Patent Number: 5,791,644

[45] Date of Patent: *Aug. 11, 1998

[54] RETAINER AND REGISTRATION MECHANISM FOR MEDIA PROCESSING

[75] Inventors: Laurent A. Regimbal, Eagle, Id.; Martha Patricia Salas Sanchez; Lenin Gallegos, both of Jalisco, Mexico

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 745,963

[22] Filed: Nov. 8, 1996

[51] Int. Cl.[6] ..... B65H 39/02

[52] U.S. Cl. ..... 270/58.12; 270/58.17; 270/58.27

[58] Field of Search ..... 270/58.08, 58.12, 270/58.16, 58.17, 58.27

[56] References Cited

U.S. PATENT DOCUMENTS

| | | | |
|---|---|---|---|
| 3,690,537 | 9/1972 | Turner et al. | 227/88 |
| 3,847,388 | 11/1974 | Lynch | 271/174 |
| 5,112,034 | 5/1992 | Uto et al. | 270/58.12 |
| 5,288,062 | 2/1994 | Rizzolo et al. | 270/58.12 |
| 5,603,492 | 2/1997 | Mandel et al. | 270/58.14 X |
| 5,639,078 | 6/1997 | Mandel et al. | 270/58.17 X |

FOREIGN PATENT DOCUMENTS 2104494 3/1983 United Kingdom .

*Primary Examiner*—Hoang Nguyen
*Attorney, Agent, or Firm*—Lane R. Simmons

[57] ABSTRACT

A media retaining and registration apparatus retains and aligns media by pulling the media to a registration location rather than pushing the media to registration in preparation for finish processing of the media, including stapling, hole punching, binding or the like. The apparatus includes a holding bed adapted to receive media thereon; a registration wall disposed adjacent the holding bed for providing an alignment reference area for the media on the holding bed; at least one finger movably disposed adjacent the registration wall; and, means for moving the at least one finger such that contact is made with a surface of the media in the holding bed for pulling and positioning the media adjacent the registration wall. The finger is disposed on a rotatable shaft adjacent the registration wall, and is configured to contact and retain the media in the holding bed and also pull the media in the holding bed to the registration wall as the shaft is rotated. Upon further rotation of the shaft, the finger is configured to slide over the media and rotate around to capture and slidably retain an edge of a next media received by the holding bed. Preferably, the finger is formed of an elastomer material.

23 Claims, 4 Drawing Sheets

RETAINER AND REGISTRATION MECHANISM FOR MEDIA PROCESSING

FIELD OF THE INVENTION

This invention relates in general to media processing and, more particularly, to preparing the media for finishing operations using automated retaining and registration apparatus.

BACKGROUND OF THE INVENTION

Many image forming apparatus, such as laser printers and copy machines, employ automated stapling mechanisms which act upon the media after completion of imaging or other general processing. In addition, these apparatus may also perform various other finishing operations on the media, such as binding, hole punching, or the like. In each case, the media (generally paper) must be aligned along one or more prescribed axes for proper stapling, binding, punching, etc. Proper alignment (registration) is key to providing accurate and satisfactory finishing operations upon the media.

Conventional methods of media registration utilize bars or arms that "push" the paper into the registration position, either in the paper path direction and/or perpendicular to the paper path direction. One disadvantage of this type of registration method (and mechanism) is that it does not ensure that the paper stays in the proper position once the paper has been "pushed" there. Another disadvantage of the "push" method is that it typically requires larger and more complex mechanisms to accomplish the task. An even further disadvantage is that it relies on the paper's physical characteristics to function properly which can be seriously problematic if the paper has been curled or otherwise deformed (for example, as a result of the imaging process of a laser printer or photocopier).

Accordingly, objects of the present invention include providing an improved means and method for retaining and aligning media that is to be physically acted upon, such as for finishing operations including stapling, binding or hole punching.

SUMMARY OF THE INVENTION

According to principles of the present invention in a preferred embodiment, a media registration apparatus retains and aligns media by pulling the media to a registration location rather than pushing the media to registration. The apparatus includes a holding bed adapted to receive media thereon; a registration wall disposed adjacent the holding bed for providing an alignment reference area for the media on the holding bed; at least one finger movably disposed adjacent the registration wall; and, means for moving the at least one finger such that contact is made with a surface of the media in the holding bed for pulling and positioning the media adjacent the registration wall.

According to further principles in a preferred embodiment, the finger is disposed on a rotatable shaft adjacent the registration wall, and is configured to contact and retain the media in the holding bed, and also pull the media in the holding bed to the registration wall as the shaft is rotated. Upon further rotation of the shaft, the finger is configured to slide over the media and rotate around to capture and slidably retain an edge of a next media received by the holding bed. Preferably, the finger is formed of an elastomer material.

The present invention provides an improved mechanism and method for retaining and aligning media in preparation for finish processing of the media, including stapling, hole punching, binding or the like.

Other objects, advantages, and capabilities of the present invention will become more apparent as the description proceeds.

DETAILED DESCRIPTION OF THE INVENTION

Figure 1:
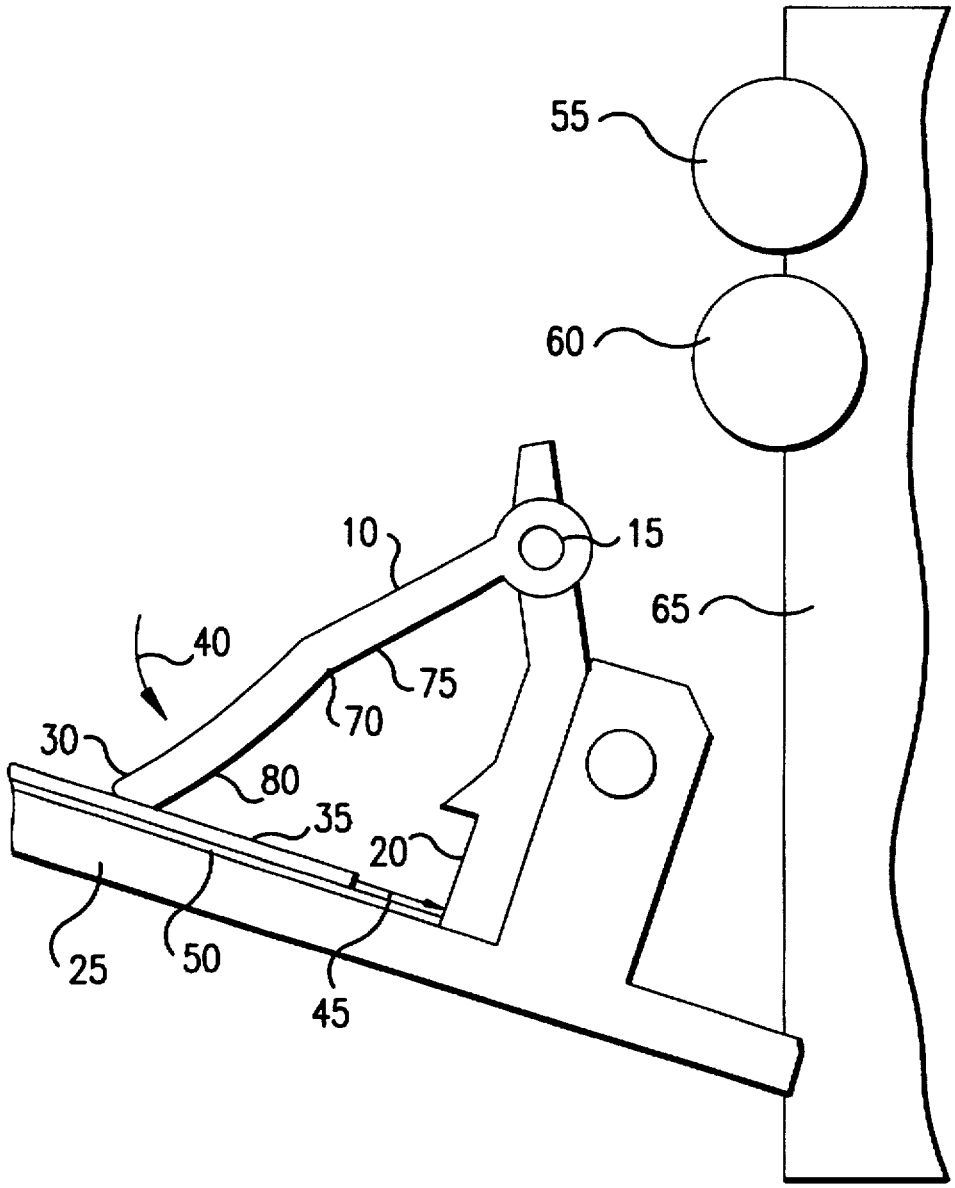
FIGS. 1–3 are side elevation views of the present invention media retaining and registration mechanism, each view depicting a "snap shot" of the mechanism as it rotates about an axis for retaining and registration purposes of the media.

FIG. 1 is a side elevation view of the present invention media retaining and registration mechanism. Finger 10 is attached to rotatable shaft 15 which is disposed near registration wall 20 of media holding bed 25. Distal end 30 of finger 10 is in contact with a surface of medium (paper) 35. Finger 10 is shown in its "retaining" position (i.e., holding paper 35 in place), although potential rotational motion is shown by directional arrow 40 about the axis defined by shaft 15. Finger 10 is thus capable of retaining paper 35 in holding bed 25, and also capable of subsequently pulling paper 35 into alignment (registration) with registration wall 20, as depicted by directional arrow 45. Paper 50 is shown as already having been aligned with registration wall 20 by finger 10. Media 35 and 50 were previously fed onto holding bed 25 through feed rollers 55 and 60 of printer (or paper delivery head) 65. Advantageously, finger 10 pulls media 35 and 50 to registration at wall 20, rather than pushing the media to the wall as done in the conventional art.

Throughout this description, it will be understood that the terms medium and media are used generally to mean any sheet of paper, envelope, cardstock, transparency, or other medium capable of being used in image processing devices or other media processing devices. Furthermore, laser printer (or paper delivery head) 65 is depicted in partial block diagram as being representative of the many media processing devices, such as printers, photocopiers, facsimiles, etc., or other paper handling devices that are configured to align media for finish processing or the like. Furthermore, although holding bed 25 is described generically, it is representative of any bed used for finish processing, such as for stapling media 35 and 50, or hole punching or binding the same. Any conventional mechanism for stapling, binding or punching may be used in connection with the present invention, and the same are not shown so as to avoid congestion of the drawings. Also, although printer 65 and holding bed 25 are shown as being attached, the drawing is merely an exemplary configuration.

Continuing with FIG. 1, although only one finger 10 is shown for simplicity purposes, at least two fingers are preferred in connection with shaft 15 to provide the best retaining and pulling of media 35 and 50 for positioning into registration. Also, holding bed 25 is, preferably, angled with respect to gravitational forces such that the media disposed thereon tends toward registration wall 20 by the gravitational forces to assist finger 10 in the registration process.

In a preferred embodiment, finger 10 is formed of an elastomer material although other materials will work. Although in a preferred embodiment finger 10 is formed to be only roughly about one half inch in total length, the important feature is that it be longer than the distance between the centerline of shaft 15 and bed 25 so as to be forced to bend as it is rotated past registration wall 20. An elastomer material provides a good balance between a needed coefficient of friction for gripping the media to pull the media to the registration wall, rigidity for applying retaining force to the media, and flexibility for rotating past the media and around to capture the next paper received in the holding bed. Furthermore, although the shape of finger 10 isn't critically important, a preferred shape provides a jointed effect to the finger as shown at 70. First and second portions 75 and 80 of finger 10 form an obtuse angle therebetween at joint 70 when the finger is in a "resting" state (no forces acting upon the finger). This configuration satisfies the needed gripping, flexibility and rigidity discussed.

FIG. 1 shows finger 10 and shaft 15 disposed at the rear of holding bed 25 for pulling media 35 and 50 against a single registration wall 20. In this exemplary configuration, the media is aligned in the direction of the paper path (referred to herein as "y" axis registration) because the media is received through feed rollers 55 and 60 of printer 65 into holding bed 25, and then pulled back by finger 10 (along the same "y" axis as the paper path) to registration wall 20. However, although not shown because of similarity and simplicity of implementation, it is understood that the invention is equally configurable for "x" axis (perpendicular to the paper path) retaining and registration purposes. Or, the invention may be implemented to provide both "x" and "y" axes retaining and registration, either by using two shafts and respective fingers, with each shaft positioned parallel to its axis of registration, or by using a single shaft disposed at a generally 45 degree angle with respect to each axis. In the 45 degree angle implementation, the fingers pull the media to the vertex point where each axis of registration meets the other. Regardless of the implementation, however, it is also obvious to those of ordinary skill in the art (and therefore not shown in the Figure) that shaft 15 is rotated by conventional gear and motor techniques, or other means available in the art, and controlled by appropriate firmware, software, hardware or the like. Moreover, the rotary position of the fingers is controlled by a hall-effect sensor/magnet pair as conventional in the art, although other sensing technology is also usable.

Figure 2:
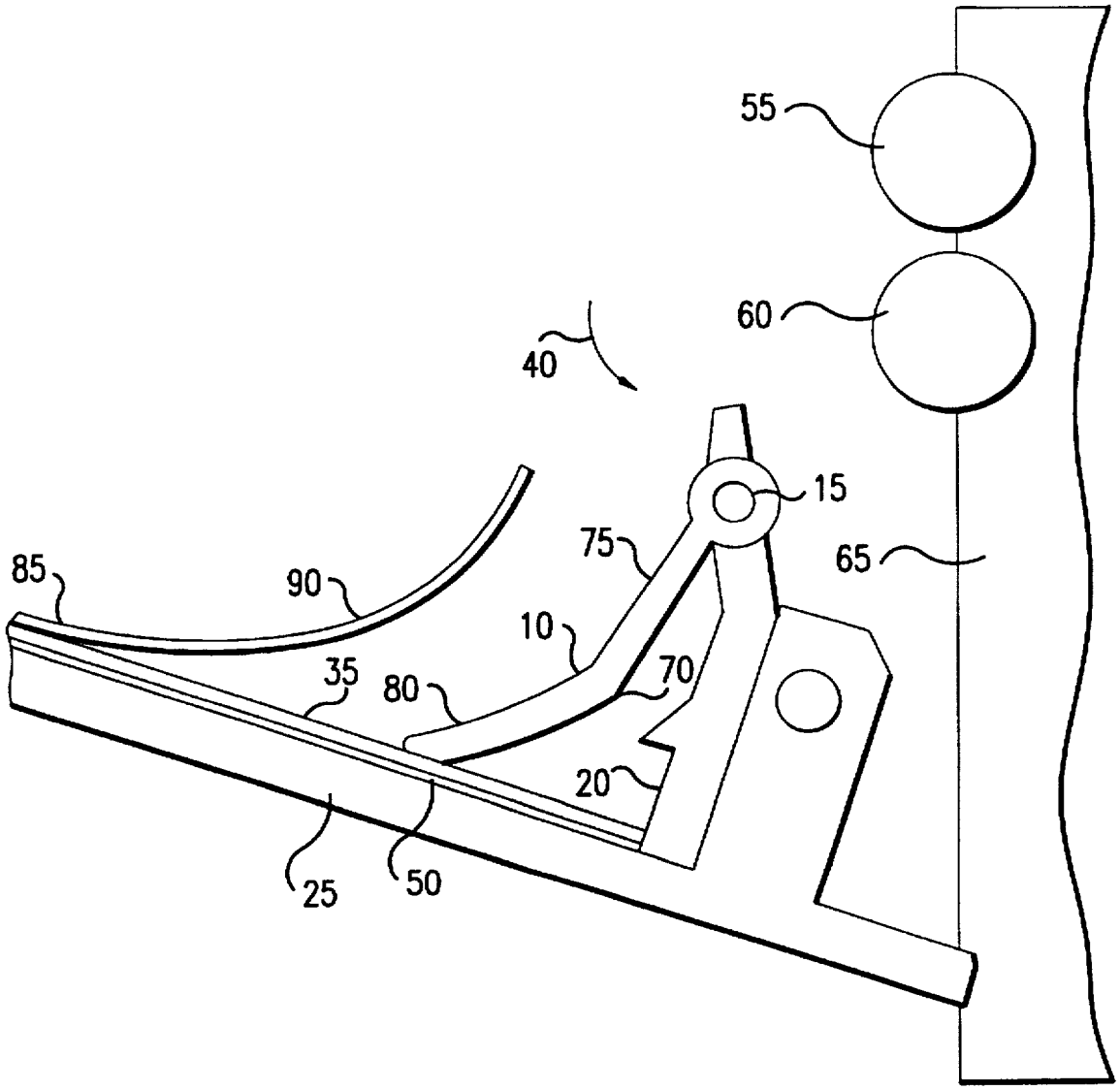

Referring now to FIG. 2, finger 10 is shown as having pulled media 35 against registration wall 20 in response to a next medium 85 having been received onto holding bed 25 from feed rollers 55 and 60 of printer 65. Medium 85 is shown as having a curved edge 90 (formed, typically, from image processing through printer 65). Shaft 15 has rotated further around (relative to FIG. 1) about the axis of rotation as defined by shaft 15 and as designated by arrow 40, such that finger 10 has pulled medium 35 against wall 20 into an aligned position. First and second portions 75 and 80 of finger 10 are now bent even further relative to each other as the finger continues rotation. The bending is due to the finger being longer than the distance between the centerline of shaft 15 and holding bed 25.

Figure 3:
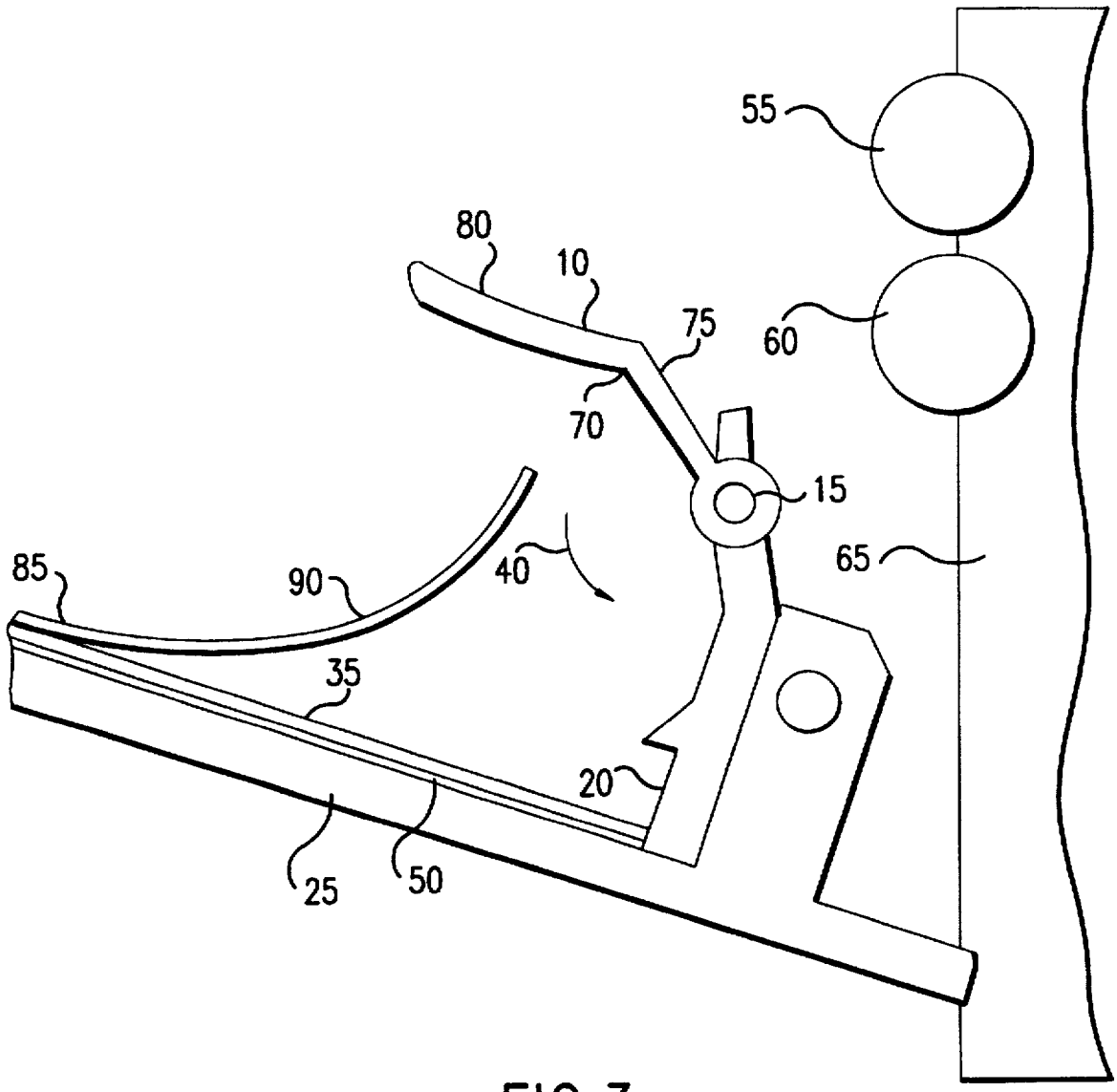

FIG. 3 shows how shaft 15 has rotated finger 10 even further on around the axis of rotation such that finger 10 is now situated over next medium 85. At this point, finger 10 is in its "resting" state (no forces acting upon the finger), whereby joint 70 defines an obtuse angle between first and second portions 75 and 80 of finger 10. This configuration is especially helpful for capturing and retaining next medium 85 because, as shown in this example, medium 85 happens to have a curved edge 90.

Since in the examples depicted in FIGS. 1–3 finger 10 is configured to register the media only along the "y" axis, finger 10 remains in the position (shown in FIG. 3) until "x" axis registration occurs. This status position allows the media to slide under second portion 80 of finger 10 during "x" axis registration. As previously discussed, "x" axis registration may occur using another finger of the present invention disposed on a shaft or other rotational mechanism along the "x" axis. Alternatively, other conventional means, such as a bar or arm, may be used to register the media to the "x" axis prior to registration along the "y" axis with the shown invention.

In any case, once "x" axis registration occurs and "y" axis registration is to occur (as previously described in FIGS. 1 and 2), an advantage of the present invention is that when medium 85 is contacted and pulled by finger 10 to registration against wall 20, curl 90 is of minimal concern as compared to the prior art. Specifically, the prior art pushes the media into registration, whereas the present invention pulls it into registration. In the case of a curled edge as shown, pushing from an opposite end of the medium will cause inaccurate registration because of the curled end. On the other hand, the present invention finger presses down against the curled end and pulls the medium to registration, thus providing improved accuracy for registration.

Figure 4:
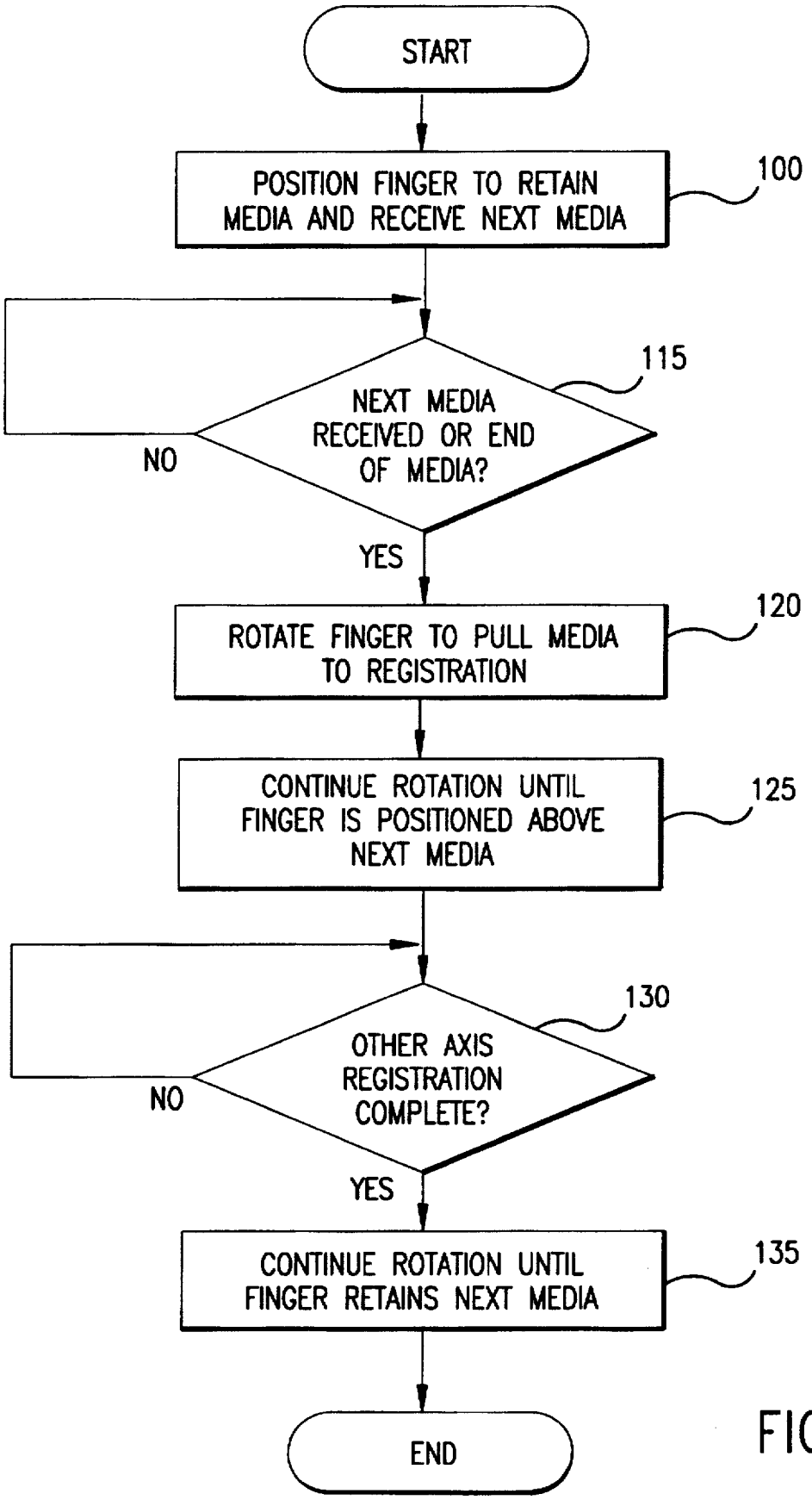
FIG. 4 is a flow chart diagram depicting a method of the present invention for retaining and registering media.

Referring now to FIG. 4, a flow chart depicts a preferred method of the present invention for retaining and registering media as applied to the mechanism of FIGS. 1–3. First, 100, shaft 15 and finger 10 are rotated to position the finger in contact with any existing media 35 in holding bed 25. This status retains the media in the bed and is preparatory to receiving any further media in the bed. FIG. 1 depicts this positional status. If no media is in the holding bed, then the finger simply contacts the bed.

Next, if a sheet of paper 85 has been received 115 onto holding bed 25, then finger 10 is rotated 120 to pull the media into registration for the designated axis. FIG. 2 depicts this positional status. Then, rotation continues 125 until finger 10 is positioned above next media 85. FIG. 3 depicts this positional status. Subsequently, if registration has occurred for the next media 130 for an opposing axis of registration (relative to the axis in which finger 10 is disposed), then finger 10 is further rotated 135 to contact and retain next media 85 in holding bed 25. FIG. 1 depicts an example of this positional status.

In summary, and in a preferred embodiment, the retainer/registration mechanism of the present invention includes a shaft 15 having preferably two elastomeric fingers 10 disposed thereon. Shaft 15 includes a gear on one end that is driven by a DC motor. The rotary position of the fingers is controlled by a hall-effect sensor/magnet pair. The shaft is mounted near the prescribed media registration location, such as, for example, at the rear of a holding bed 25 where sheets of paper 35, 50 are stacked in preparation for a finishing operation (i.e., stapling, hole punching, binding, etc.). The fingers are positioned over any existing media in holding bed 25 when the next paper is received. Once the next sheet has been deposited on holding bed 25, the fingers/shaft are rotated nearly a complete turn. Since the fingers are longer than the distance between the shaft centerline and the holding bed, the fingers are forced to bend as they rotate past the registration wall. This bending produces a force on the sheet parallel to the holding bed in the direction of the registration wall. This force "pulls" the paper back against registration wall 25 and properly positions the page for stapling.

A key advantage of the present invention is that the media is "pulled" into place as opposed to being "pushed". This is advantageous because the inventive mechanism (finger/shaft) can be located at the edge of the paper nearest the registration reference. This is important because paper is conventionally placed in the holding bed based on an edge that is always required to be in that location (such as for finishing purposes). This is quite different than a pushing type mechanism that must be designed to compensate for a variety of locations that may occur for the edge that will be pushed. Edge locations may vary due to the differing sizes or orientations of paper being pushed. For example, registration capabilities vary as between the present invention and conventional methods for a sheet of letter size paper (8.5"×11"), depending on whether the paper is fed into the holding bed in portrait mode or landscape mode. The present invention is able to register either orientation without any extraneous calculations or movement because the edge that is to be placed against the registration wall is always located in the same place.

In contrast, conventional systems and methods must be adjusted to compensate for the orientation difference. Specifically, a bar or arm "push" system has a minimum travel distance of 2.5 inches (if the sheet is in landscape mode), not counting the travel required to positively register the sheets. This is due to the fact that the edge that the conventional arm would push on is either 8.5" or 11" from the registration wall when properly located. Other advantages of the present invention include its simplicity of construction and materials, compact size, and the fact that paper curl is controlled in addition to registering the sheets of paper.

What has been described above are the preferred embodiments for a retainer/registration mechanism for media processing. It will be obvious to one of ordinary skill in the art that the present invention is easily implemented utilizing any of a variety of components existing in the art. Moreover, while the present invention has been described by reference to specific embodiments, it will be apparent that other alternative embodiments and methods of implementation or modification may be employed without departing from the true spirit and scope of the invention.

What is claimed is:

1. A media registration apparatus, comprising:

(a) a holding bed adapted to receive media thereon;

(b) a registration wall disposed adjacent the holding bed for providing an alignment reference area for the media on the holding bed;

(c) at least one finger movably disposed adjacent the registration wall;

(d) means for moving the at least one finger such that contact is made by the at least one finger with a surface of the media in the holding bed for positioning the media adjacent the registration wall; and, (e) means for holding the at least one finger in a first static position in contact with the media for retaining the media in the holding bed subsequent to positioning the media adjacent the registration wall and while a next media enters into the holding bed.

2. The apparatus of claim 1 wherein the registration wall is adapted to be a part of the holding bed.

3. The apparatus of claim 1 further including means for holding the at least one finger in a second static position above the media while the media is aligned to an axis different from an axis associated with the registration wall.

4. The apparatus of claim 1 wherein the at least one finger is rotatably disposed adjacent the registration wall.

5. The apparatus of claim 4 wherein the at least one finger is configured to pull the media in the holding bed to the registration wall as the finger is rotated.

6. The apparatus of claim 5 wherein the at least one finger is configured to slide over the media upon further rotation of the finger after the media has braced against the registration wall.

7. The apparatus of claim 3 wherein the at least one finger is configured to capture and slidably retain the media while the at least one finger is in the second static position.

8. The apparatus of claim 7 wherein the at least one finger is configured to capture and slidably retain a curled edge of the media.

9. The apparatus of claim 1 wherein the at least one finger is formed of an elastomer material.

10. The apparatus of claim 1 wherein the holding bed is disposed at an angle relative to gravitational forces such that the media disposed thereon tends toward the registration wall by the gravitational forces.

11. The apparatus of claim 1 further including a media finishing mechanism in cooperation with the holding bed for acting upon the media positioned adjacent the registration wall.

12. The apparatus of claim 11 wherein the finishing mechanism is selected from a stapling mechanism, a hole punching mechanism, or a binding mechanism.

13. A media registration apparatus, comprising:

(a) a holding bed adapted to receive media thereon;

(b) a registration wall disposed adjacent the holding bed for providing an alignment reference area for the media on the holding bed;

(c) a shaft disposed near the registration wall;

(d) at least one finger disposed on the shaft such that the at least one finger extends generally away from and perpendicular to the shaft;

(e) means for rotating the shaft such that the at least one finger contacts a surface of the media in the holding bed for pulling the media adjacent the registration wall;

(f) means for further rotating the shaft and for holding the at least one finger in a first static position above the media for slidably retaining the media in the holding bed subsequent to positioning the media adjacent the registration wall and while the media is registered in an axis different from an axis associated with the registration wall; and, (g) means for further rotating the shaft and for holding the at least one finger in a second static position in contact with the media for retaining the media in the holding bed subsequent to holding the at least one finger in the first static position and while a next media enters into the holding bed.

14. The apparatus of claim 13 wherein the shaft is disposed, alternatively, parallel to the registration wall or at an angle away from the registration wall.

15. The apparatus of claim 13 wherein the at least one finger is formed of an elastomer material.

16. A method of aligning media for processing, comprising:

(a) placing first media in a holding bed near a shaft disposed adjacent the holding bed, the shaft having at least one finger thereon;

(b) rotating the shaft such that the at least one finger contacts a surface of the first media;

(c) pulling the first media to a registration wall disposed near the shaft by continuing rotation of the shaft with the at least one finger in contact with the surface of the first media;

(d) further continuing rotation of the shaft such that the at least one finger releases contact with the first media, continues rotating about the shaft, and subsequently contacts the first media again; and, (e) holding the at least one finger in a static position after it contacts the first media again for retaining the first media in the holding bed while a next media enters into the holding bed.

17. The method of claim 16 wherein the at least one finger is formed of an elastomer material.

18. The method of claim 16 wherein the step of pulling the first media to the registration wall occurs upon an event of a next media being placed in the holding bed, and upon an event of the first media being a final media placed in the holding bed.

19. The method of claim 16, after continuing rotation of the shaft and prior to subsequently contacting the first media again, further including the step of pausing rotation of the shaft such that the at least one finger captures and slidably retains the first media.

20. The method of claim 19 wherein the at least one finger captures and slidably retains a curled edge of the first media.

21. The apparatus of claim 1 wherein the at least one finger comprises first and second portions connected by means of a flexibly biased joint, the portions forming an obtuse angle therebetween when the at least one finger is not in contact with the media.

22. The apparatus of claim 1 wherein the media registration apparatus is disposed in operation with an image forming device.

23. The method of claim 19 wherein the at least one finger slidably retains the first media while the first media is aligned to an axis different from an axis associated with the registration wall.

* * * * *